US005224901A

United States Patent [19]

Dahl et al.

[11] Patent Number: 5,224,901

[45] Date of Patent: Jul. 6, 1993

[54] APPARATUS AND METHOD FOR DISPLAYING AN ANAMORPHIC ILLUSION

[75] Inventors: Robert M. Dahl, Sun Valley; John A. Werner, Sunland; Joseph P. Cotter, Pasadena; Edmond J. Haro, La Crescenta, all of Calif.

[73] Assignee: The Walt Disney Company, Burbank, Calif.

[21] Appl. No.: 895,773

[22] Filed: Jun. 9, 1992

[51] Int. Cl.[5] ..... G09F 1/00

[52] U.S. Cl. ..... 472/63; 40/433; 40/474

[58] Field of Search ..... 472/63, 61, 57; 40/474, 40/427, 433, 434; 359/857, 849, 850, 839

[56] References Cited

U.S. PATENT DOCUMENTS

| | | | |
|---|---|---|---|
| 2,132,472 | 10/1938 | En Holm | 472/63 |
| 2,786,292 | 3/1957 | Growes | 40/434 X |
| 2,891,338 | 6/1959 | Palamara | 40/474 X |
| 3,762,082 | 10/1973 | Mincy | 40/433 |
| 3,834,051 | 9/1974 | Barnes, Jr. et al. | 472/63 X |
| 4,195,910 | 4/1980 | Imes, Jr. | 40/474 X |
| 4,909,501 | 3/1990 | Hoffman | 472/63 |
| 5,041,947 | 8/1991 | Yuen et al. | 40/433 X |

OTHER PUBLICATIONS

M. Schuyt and J. Elffsers, *Anamorphoses, Games of Perception And Illusion in Art*, Harry N. Abrahams, Inc. (1976) FIGS. 4, 67 (no page Nos.).

*Primary Examiner*—Richard E. Chilcot, Jr.
*Assistant Examiner*—Kien Nguyen
*Attorney, Agent, or Firm*—Richard S. Erbe

[57] ABSTRACT

An apparatus and method for displaying an anamorphic illusion utilizes two flat disks, each having different unrecognizable images on their top surfaces. A reflecting surface is positioned perpendicular to the disks. A viewer is able to see a recognizable composite reflected image of the two unrecognizable images by looking at the reflecting surface from any position around the circumference of the apparatus. Rotational motion is imparted to one of the two disks, creating an animated display on the reflecting surface. In another embodiment of the invention, lighting is added above and underneath the disks to illuminate the display and create a vivid and eye-catching attraction under any lighting conditions.

11 Claims, 4 Drawing Sheets

APPARATUS AND METHOD FOR DISPLAYING AN ANAMORPHIC ILLUSION

BACKGROUND OF THE INVENTION

1. Field of the Invention

The present invention relates generally to optical devices and, more particularly, to an apparatus for creating and displaying an anamorphic illusion.

2. Description of the Related Art

For several centuries, artists have been utilizing techniques involving the manipulation of perspective views to create surprising and pleasing illusions. Famous artists such as da Vinci and Holbein used a curious and fascinating effect that we now know as "anamorphic" (from the Greek ana (again), and morphe (shape)). This effect presents the viewer with a totally unrecognizable representation of reality, which can only be restored to its true recognizable form when the image is viewed from an oblique angle, or if it is reflected in a cylinder, cone, or prism.

The idea of central perspective not only rationalizes the relationship between objects within a picture, but also establishes a relationship between the viewer and the represented images. Anamorphoses are an extreme example of this phenomena. The viewer is first deceived by the appearance of a barely recognizable or distorted image, and is then directed to a view-point dictated by the formal construction of the viewed rendering. The origin of the word, as noted above, indicates that the viewer must play a part and re-form the picture himself.

The kinds of anamorphoses that require a reflecting cone or cylinder for correct viewing have an entirely different origin from perspective anamorphic representations.

These types of anamorphoses (those requiring a reflecting cone or cylinder), which were introduced to Europe in about the 17th century, were popularized by Niceron, who made practical use of the discovery. It was in France that illustrated descriptions of the methods of producing such anamorphic representations were published for the first time. It was not long before this type of anamorphic representation eclipsed the perspective anamorphosis. The dimensions were more manageable, viewing was easier, and the element of surprise was much greater. Particularly in the case of cone anamorphosis, the subject could be completely concealed. A variant of these types was the anamorphosis for the reflecting pyramid.

In a typical reflecting cone or cylinder anamorphic illusion, a painting or other type of rendering is presented to the viewer, with the represented image distorted so as to be unrecognizable. A reflecting cone or cylinder is placed on a predetermined point on and perpendicular to the painting or rendering. The viewer, by moving to a particular location, can view the recognizable (undistorted) image in the cylinder or cone.

An informative text on the subject is *Anamorphoses, Games of Perception and Illusion in Art* by Michael Schuyt and Joost Elffsers, published by Harry N. Abrahams, Inc., 1976, Library of Congress Card No. 76-25735. This text describes the various types of anamorphoses already referred to and explains techniques by which the unrecognizable anamorphic depiction of the subject matter is related to geometrical shapes constituting volumes of revolution, such as cones and cylinders, such that the reflected image of the anamorphic depiction is reformed into recognizable subject matter for the viewer. In this application, the term "anamorphic depiction" will be used to indicate the unrecognizable depiction of the subject matter which is placed in appropriate position to the relecting surface to provide a reflected image which returns the subject matter to a configuration recognizable to the viewer. In using the terms "recognizable" and "unrecognizable" we mean, for example, representational subject matter such as a representational painting of a scene which in its anamorphic form is so distorted that is loses its ability to be recognized by the viewer but is returned to its apparent original form in its image appearing in the reflecting surface. Of course, an anamorphic illusion is not confined to representational art but may be appliced to geometric forms, familiar patterns, numbers, letters and so on.

Although effective for their intended purpose of amusement, structures for achieving an anamorphic illusion were best suited to the salon or museum. For example, in the referred to text by Schuyt and Elffers at illustrations 67, there is shown a vertical reflecting cylinder extending upwardly from a horizontal painting which bears an anamorphic illustration, distorted beyond ordinary recognition, of the crucifixion. The reflection of the anamorphic depiction of the crucifixion in the vertical cylinder is, however, reformed to a fully recognizable, representational image of the crucifixion scene. Such a structure, however, has limitations which would not suit it for a theme park attraction for which the present invention is intended. In particular, the thus described anamorphic display apparatus does not have the capability for relative motion between different objects in the scene. For theme park use, relative motion in a picture attracts the eye and makes the illusion more convincing and interesting to the viewer; for example, hot air balloons drifting in motion over a city are more attention getting and interesting to a theme park viewer than a static view of the same scene.

Another problem is that a museum type display is not particularly well suited for applications where lighting conditions reduce the intensity of the reflected image to such a low threshold that it lacks the vividness and excitement to attract theme park viewers to the attraction. The same could be said for applications where lighting levels, either because of facility limitations or for show effect, are quite low.

Another problem is that, in a theme park environment, it is important to have a structure on which viewers may stand to view in the correct horizontal and vertical location necessary to most satisfyingly obtain the intended anamorphic illusion and the attraction and which prevents them from coming so close that they may damage it.

Another problem is that known configurations must be viewed from one particular location in order to see the recognizable image or information. In a theme park application, for example, where a large number of guests must pass through a restricted area in a short period of time, the requirement of the guests to be located at one optimum point to view the illusion could create traffic bottlenecks, potential safety hazards and general incovenience as guests attempt to view the recognizable image.

From the foregoing description, it should be apparent that there is a need for an apparatus for displaying an anamorphic illusion that is eye-catching, provides adequate lighting for any environment, and could provide optimum viewability from any point around the apparatus. The present invention satisfies this need and provides further related advantages.

SUMMARY OF THE INVENTION

The just-described problems of the prior art are addressed and solved by the present invention. In particular, the present invention provides an apparatus for amazing a viewer by showing him an anamorphic depiction, which unrecognizably distorts its subject matter, and reflected images of the scene which reform the subject matter to a recognizable scene, in which parts of the subject matter are seen to move relative to other parts, e.g., hot air balloons drifting over a city skyline. This capability for motion within the anamorphic illusion is believed to advance the art and significantly increase the ability to draw the attention of viewers as in a theme park attraction.

This result is achieved by positioning a reflecting surface, configured as a volume of revolution about a vertical axis, above a base which supports it. A transparent first surface, supported by the base, extends around the reflecting surface at its lower end, projecting outwardly from it. Beneath the transparent first surface is a second surface. One of the surfaces is supported by the base for rotation about the vertical axis of the reflecting surface, in generally coextensive relation with the other surface. The first and second surfaces bear anamorphic depictions of first and second subject matter comprising the scene which is to be rendered recognizable. The relationship between the anamorphism of the depictions and the configuration of the reflecting surface is such that a viewer, seeing the reflecting surface, finds the unrecognizable anamorphic depiction of the scene reformed to the recognizable scene in the images reflected in the reflecting surface. In an important advance, one of the surfaces is rotated relative to the other to enable the viewer to see motion occurring between portions of the subject matter of the recognizable scene in the reflecting surface.

Another important aspect of the present invention is the provision of illumination both external to the invention and underlying the first and second surfaces coupled with using first and second surfaces which are transparent or at least translucent. The underlying lighting increases the intensity of the anamorphic depictions of the first and second subject matters appearing on those surfaces and correspondingly increases the vividness of the reflected images in the reflecting surface. The increased external and internal light intensity makes the anamorphic illusion more eye-catching. Very importantly, in a theme park environment, it maintains the attractiveness of the display in conditions where low light levels are present.

A further significant advantage provided by the present invention, particularly in a theme park application, is that it enables viewers to be correctly positioned to view both the anamorphic depictions and the reflected images while, at the same time, providing an easily accessible supporting structure which isolates the viewers from the artistic and reflecting portion of the apparatus that are vulnerable to damage or to soiling by accidentally dropped objects, e.g., gum, soft drinks, handbags or the like.

Other features and advantages of the invention should be apparent from the following description of the preferred embodiment, taken in conjunction with the accompanying drawings, which illustrate, by way of example, the principles of the invention.

BRIEF DESCRIPTION OF THE DRAWINGS

An anamorphic illusion apparatus, constructed in accordance with the preferred embodiment of the invention, is illustrated in the accompanying drawings in which.

DETAILED DESCRIPTION OF THE PREFERRED EMBODIMENT

Figure 1:
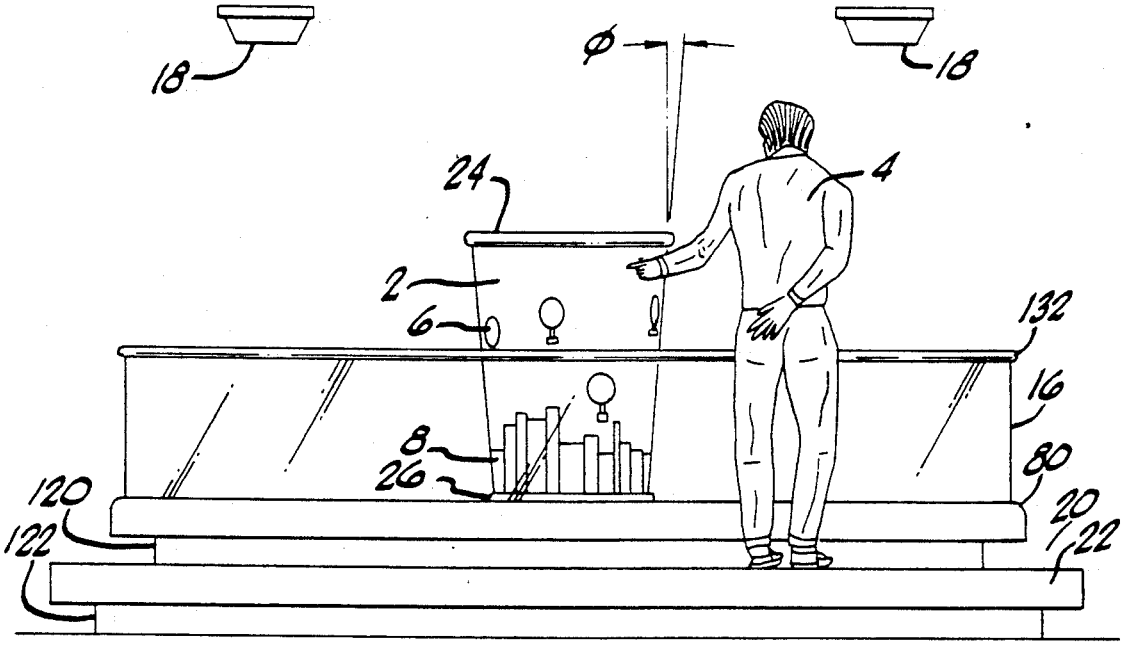
FIG. 1 is an elevational view of an apparatus in accordance with the present invention, showing the viewer, the reflecting surface, and the base.
Figure 2:
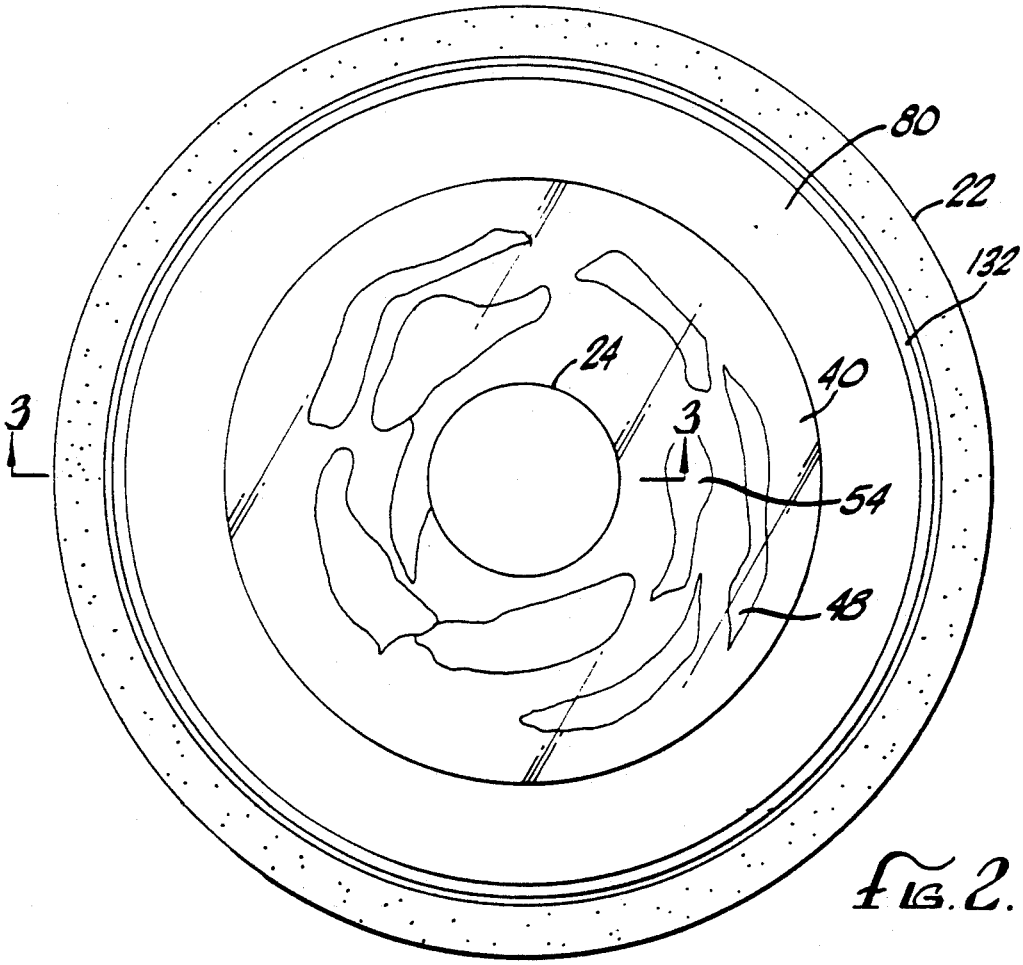
FIG. 2 is a plan view of an apparatus in accordance with the present invention, showing the base, a disk, the anamorphic depictions, and the reflecting surface.
Figure 6:
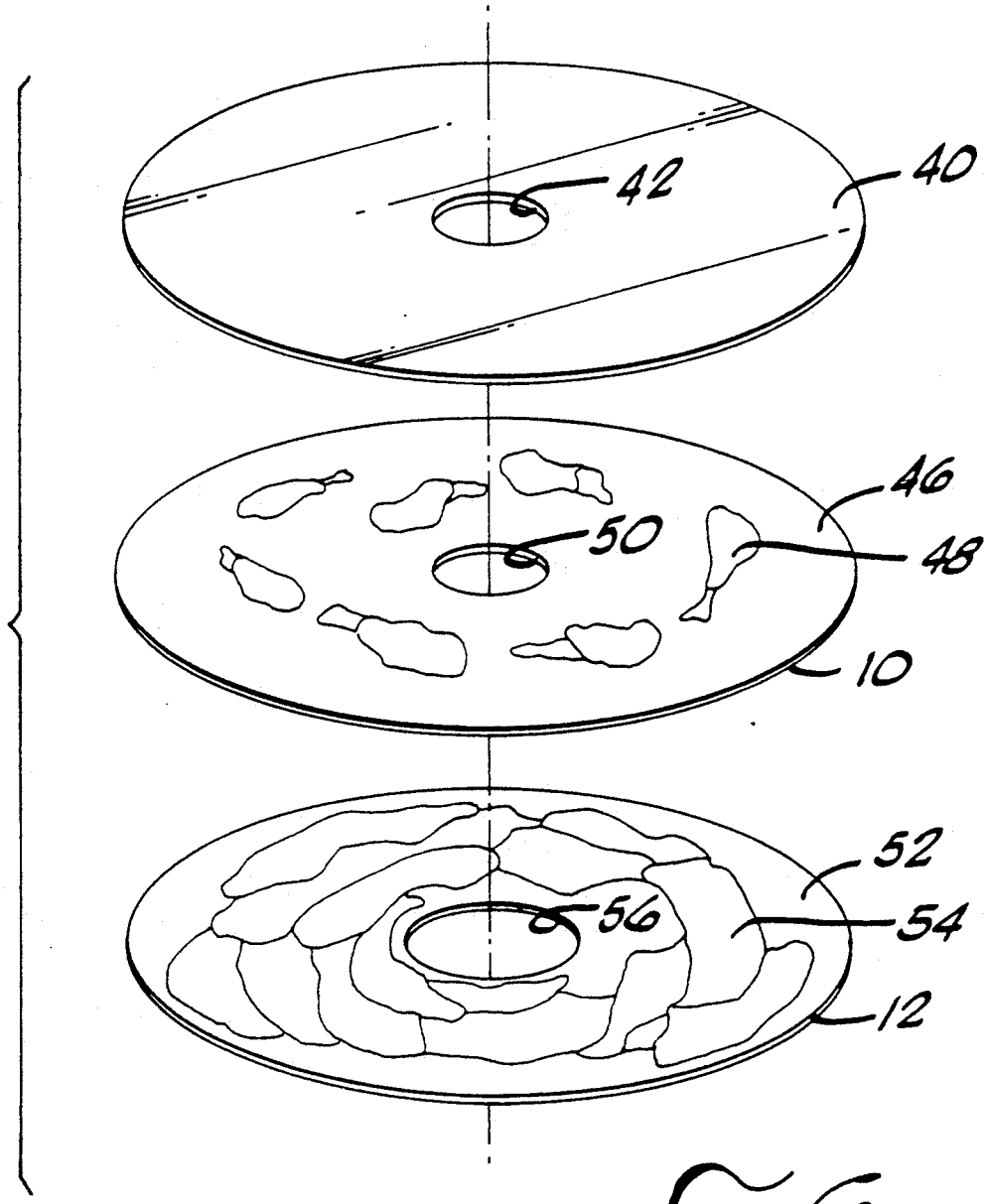
FIG. 6 is an exploded view showing the relationship between the disks and the anamorphic depictions.

An apparatus for displaying an anamorphic illusion, according to the preferred embodiment of the invention, utilizes a vertical conoidal reflecting surface 2 (FIG. 1). A viewer 4 standing near the apparatus will see reflected images 6 and 8 of first and second subject matter making up a recognizable scene, for example, hot air balloons floating over a city skyline. At the same time, the viewer 4 will be able to see that the recognizable reflected images 6 and 8 are derived from unrecognizable anamorphic depictions 48 and 54 (FIG. 2) of the first and second subject matter which appear on the upper surfaces of two disks 10 and 12 that are mounted concentrically with the reflecting surface 2, extending outwardly around its lower end. The lower disk 12 is stationary and bears anamorphic depiction 54 on its upper surface 52 to produce the reflected image 8 (FIG. 6). The upper disk 10 is transparent, so that the anamorphic depiction 54 on the lower disk 12 is not obscured, and bears the second anamorphic depiction 48 to provide the reflected image 6. The anamorphic depictions are unrecognizable when the viewer gazes directly down upon them onto the disks 10 and 12. The contrast between the unrecognizable anamorphic depictions 48 and 54 and the scene viewed in the reflecting surface 2 is amazing and interesting and calculated to make the apparatus a center of attraction for theme park guests.

A very significant aspect of the present invention relies in the ability to create relative movement within the scene reflected in the reflecting surface 2. The movement is achieved by rotating the upper disk 10 over the stationary lower disk 12 so that the anamorphic depiction 48 on the upper disk, and the recognizable reflected image 6 on the reflecting surface 2, move across the scene while the anamorphic depiction 54 on the lower disk 12, and the recognizable reflected image 8, remain stationary.

Figure 3:
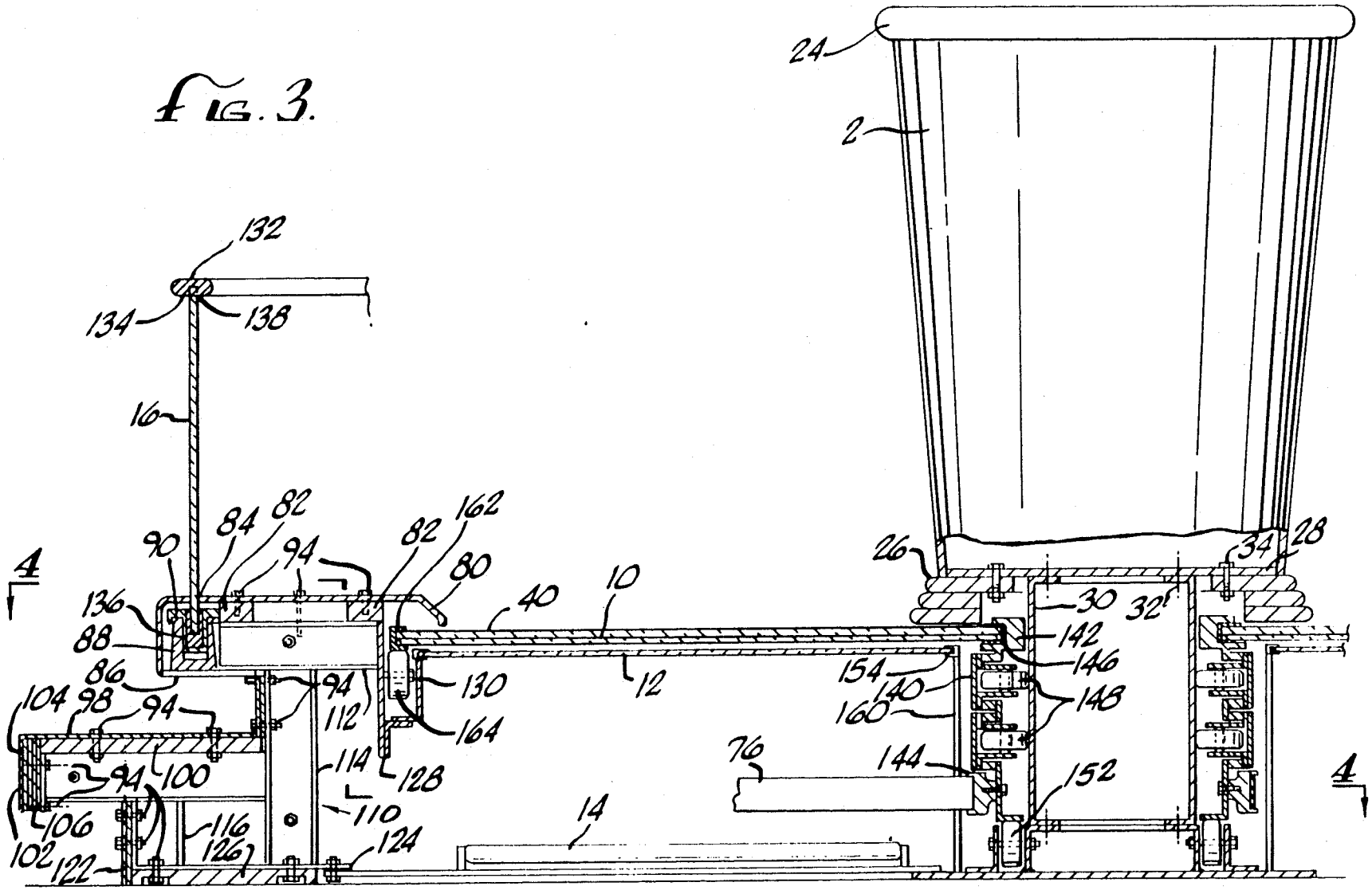
FIG. 3 is a cross-sectional, side elevational view at section 3—3 of FIG. 2 showing the reflecting surface, the supports, the structure of the base, the disks, and the disk supports.

Another important feature of the present invention is that it ensure vivid light intensity for the images reflected in the reflecting surface 2 by its own external and internal illumination system. In this way, the attraction remains bright and enticing even when poor lighting conditions or darkness prevail. To achieve this result, the lower disk 12 is itself made of translucent material. An array of radially spaced fluorescent tubes 14 is mounted beneath the lower disk 12 and extends circumferentially around and beneath the entire lower disk. The fluorescent tubes 14 brightly illuminate the translucent lower disk 12 so that it provides a bright background to the entire scene reflected in the reflecting surface 2 (FIG. 3). External to the apparatus is another lighting array 18. This external lighting array uses ultraviolet fluorescent lighting to provide further illumination to the invention and also to prevent the presence of shadows, which would detract from the effect. The anamorphic depictions appearing on the upper surface 46 of upper disk 10 are totally opaque; black light paint is used to render the depictions, with their undersides painted black. This enhances the ability of the external lighting array 18 to provide bright images in reflecting surface 2. In addition, the anamorphic depictions appearing on the lower disk 12 are rendered in translucent colored dyes, paints, photographic transparencies or other pigmentation to ensure that the objects seen in the reflecting surface 2 also appear brightly lit.

Another important aspect of the present invention resides in features which render it particularly suitable for theme park use. It is a requirement of theme parks that there be quick and ready access of guests to the attraction, that they be positioned in the right optical location for viewing the attraction, and that the attraction be protected from damage particularly where it includes such vulnerable parts as optical surfaces. To this end, the present invention includes a base 20 which extends around and outside the disks 10 and 12 and includes a ledge 22 at convenient stepping height above ground, and further includes a transparent glass screen 16 postioned between the viewer 4 and the elements of the attraction. Ledge 22 is sufficiently large to support a plurality of viewers extending around the attraction and positions them horizontally and vertically so that they can view the images reflected in the reflecting surface 2 and the anamorphic depictions from which the reflected images are derived at the same time in a convenient head position requiring unnatural or difficult viewing movements. It also allows a viewer to a platform from which to increase the image size. At the same time, the radius of the base 20 is sufficiently large to space the viewers far enough away from the reflecting surface 2 and the peripheral extremities of the disks 10 and 12 so to prevent physical contact between them and to ensure that inadvertently dropped materials, such soda pops, fast food, candy floss, handbags and the like do not fall on the optical surfaces. For further protection of the disks, a transparent glass protecting disk 40 overlies the upper disk 10 and rotates with it, and a screen 16 limits access of the viewer 4 to the optical surfaces of the attraction.

We will now describe the structure of the anamorphic illusion apparatus in greater detail.

The reflecting surface 2 (FIG. 1) can constitute a volume of revolution of different configurations. In the preferred embodiment, the reflecting surface 2 is configured as an inverted frustoconical surface having closed upper and lower end walls 24 and 26 of relatively larger and smaller diameter, respectively. The sidewall of the reflecting surface 2 is highly reflective and of good optical quality, as may be achieved by many known fabrication techniques for reflecting surfaces. The relationship between the radius and cone angle ($\phi$) of the reflecting surface and the anamorphic distortions of the anamorphic depictions 48 and 54 on the upper surfaces 46 and 52 of the upper and lower disks 10 and 12 to transform the anamorphic depictions from their unrecognizable character to recognizable reflected images in the reflecting surface is explained in texts such as the book by Schuyt and Elffers. While an inverted frustoconical shape is shown in the drawings, it will be appreciated that other shapes which are volumes of revolution may also be chosen, for example, straight cylinders and curves defined by other line generators such as curves or parabolic or elliptical shape, for example. The mathematical relationships between the contour of the reflecting surface and the degree of anamorphism required for the anamorphic depictions can, in each case, be calculated by know mathematical techniques. By using these techniques, the objects to be depicted can be transformed into anamorphic depictions appropriate for the selected contour of the reflecting surface necessary to ensure that the reflected images restore the true appearance of the object. In the preferred embodiment of the invention, it has been determined that cone angle $\phi$ is preferably in the range of angles between 0 (cylinder) and 20 degrees.

With reference to FIG. 1 in particular, the apparatus includes a base 20 and a reflecting surface 2, which has opposed upper end wall 24 and lower end wall 26. A viewer 4, by looking at the reflecting surface 2, is able to see the reflected images 6 and 8.

The lower end wall 26 (FIG. 3) of the reflecting surface 2 is secured to the apparatus by fasteners 34, through bottom plate 28. Reflecting surface 2 is further secured in place to flange 32 of support tube 30 by suitable attachment means.

In the present embodiment of the invention, reflected images 6 and 8 are reflections of anamorphic depiction 48 on the upper surface 46 of upper disk 10 and anamorphic depiction 54 on the upper surface 53 of lower disk 12. Fluorescent tubes 14 located beneath disks 10 and 12 (FIG. 3) enhance the quality and brightness of the reflected image 8. External lighting array 18, located external to and above upper disk 10 enhances the quality and brightness of the reflected image 6. It has been found that "Wildfire" black lights manufactured by Wildfire of Los Angeles, Calif., are suitable for the use in the present invention. The relationship between transparent plate 40, upper disk 10, lower disk 12 and the anamorphic depictions on their upper surfaces is show in FIG. 6. Openings 42, 50, and 56 are sized so that disks 10 and 12 and transparent disk 40 may be properly positioned relative to support tube 30 and reflecting surface 2.

Transparent disk 40 is preferably made of tempered glass to allow ultraviolet light to pass through it to enhance the images rendered in black light paint on the upper surface 46 of upper disk 10. Disks 10 and 12 are preferably made of a material such as an acrylic, that will allow light to easily pass through them. Transparent disk 40 also protects upper disk 10 and lower disk 12 from objects that might otherwise accidentally strike, fall or be thrown onto them.

Anamorphic depiction 48 and anamorphic depiction 54 are placed, respectively, on the upper surface 46 of upper disk 10 and upper surface 52 of lower disk 12. Anamorphic depictions 48 and 54 were created by implementing the use of a computer to stretch a desired artwork image to the proper configuration. The recognizable desired artwork image is first scanned into the computer by using a commercially available scanner, such as a Sharp Model JX600, which is available from Sharp, Inc. of Mahwah, N.J. One type of computer that has been found to be suitable for creating the anamorphic depictions is a "Macintosh" model fx, manufactured by Apple Computer, Inc. of Cupertino, Calif. Preferably, the "Macintosh" computer has 32 megabytes of memory and 500 megabytes of storage available. After scanning in the recognizable artwork, anamorphic depictions 48 and 54 are each produced by dividing the artwork into four equal pict file quarters. Each pict file quarter is rendered on a computer vector 3D parabolic object in concentric fashion using software called "Stratavision 1.44", manufactured by Strata, Inc. of St. George, Utah. These pict file quarters are then merged to form a 360° anamorphic pict file using "Quantel Paintbox", a software package sold by Quantel, Inc. of Newberry, Berkshire, England. After the merging is completed, the 360° anamorphic pict file is rasterized to an 8"×10" transparency using a film recorder. A suitable film recorder is a McDonald Dithwiller "Fire 1000" sold by Symbolic Science of Vancouver, British Columbia. Standard photographic enlargement techniques may be used to create transparencies of the desired size, or the anamorphic depictions 48 and 54 may be hand painted onto the disks.

In the preferred embodiment of the invention, lower disk 12 remains stationary. Lower disk 12 is secured at opening 56 by disk guides 154 which are attached by fastening devices, such as screws (not shown) to a plurality of support members 160 which are positioned around the opening. Disk guides 154 are preferably anodized aluminum extrusions, and the support members 160 are preferably constructed of ¼" carbon steel cut to suitable lengths.

The outer circumference of lower disk 12 is secured by disk guides 154 which are attached to the apparatus by bracket 106. Bracket 106 may be constructed of a suitable material such as ¼"×2"×2" aluminum angle cut to fit.

Figure 4:
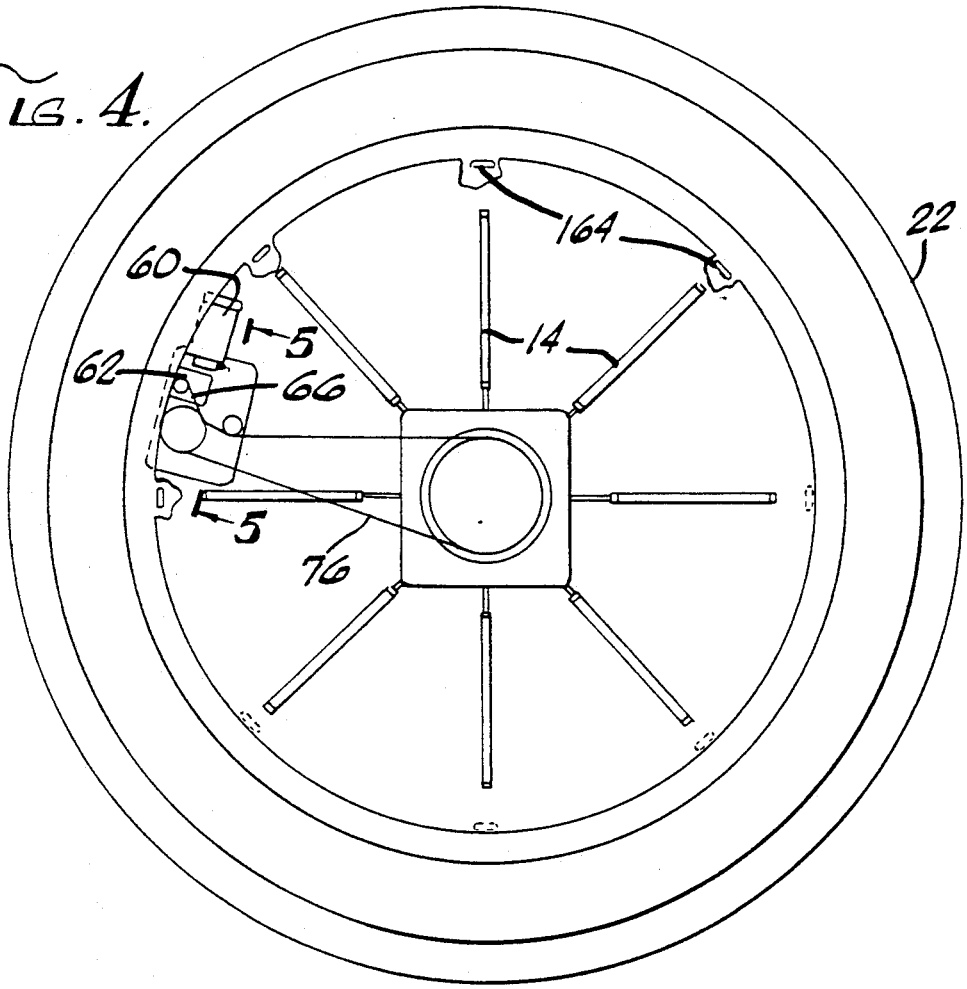
FIG. 4 is a plan sectional view at section 4—4 of FIG. 3 showing the relationship between the driving means for imparting rotational motion to the disks and the rest of the apparatus.

Transparent disk 40 and upper disk 10 are secured at their outer edges by rolled ring 162, which may be constructed of aluminum angle and which is suitably secured to transparent disk 40 and upper disk 10. Rolled ring 162 rests on a plurality of precision wheels 164 which, as shown in FIG. 4, are located around the perimeter of the disks. Each precision wheel 164 is secured to bracket 128 by a wheel fastener 130. Precision wheels 164 are fabricated from a suitable material such as polyurethane.

The opening 42 of transparent disk 40 (FIG. 3) and the opening 50 of upper disk 10 are secured to outer tube 140 by clamps 142. A rubber cushion 146 is inserted between each clamp 142 and disks 10 and 40.

Figure 5:
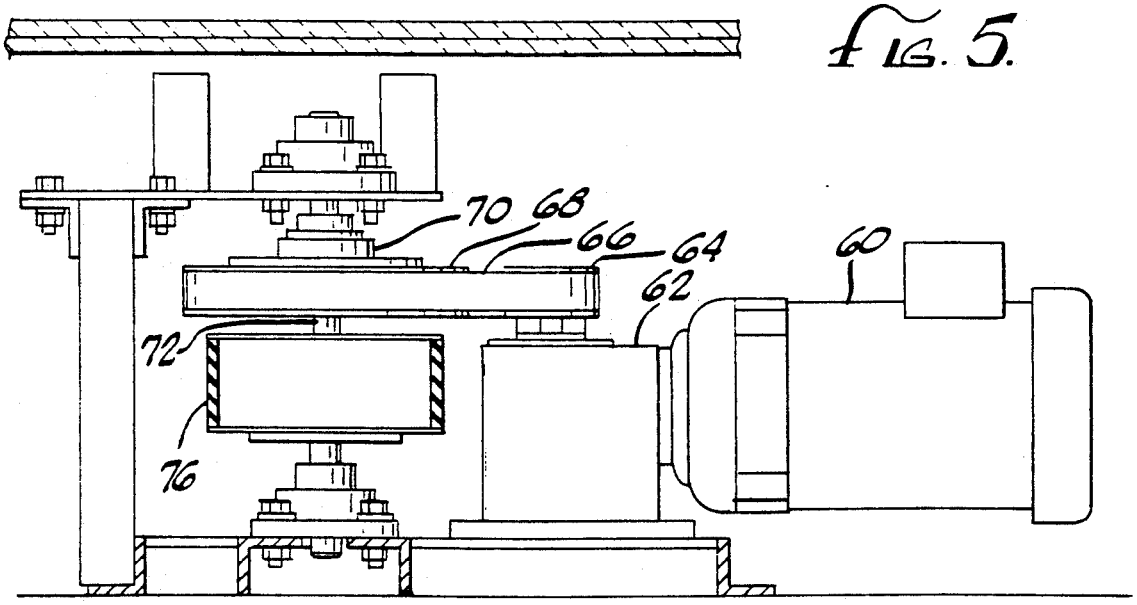
FIG. 5 is sectional side view at 5—5 of FIG. 4 of the driving means for imparting rotational motion to the disks.

In the preferred embodiment of the present invention, rotation of upper disk 10 and transparent disk 40 can enhance the reflected images 6 and 8 by creating the sense of motion to the viewer 4. FIGS. 3, 4, and 5 illustrate the details of how rotation is imparted to the disks. When gear motor 60 is provided with 3-phase electrical current, it operates in combination with gear box 62 (FIG. 5) to impart rotation to gear box pulley 64, which in turn imparts translational motion to timing belt 66, which is engaged with the teeth of gear box pulley. Gear box 62 contains a worm gear speed reducer (not shown) which allows adjustment to the turning speed of disk 40 and upper disk 10. Timing belt 66 engages with the teeth of guide pulley 68 of torque limiter 70, and causes it to rotate. Guide pulley 68 is axially connected by drive shaft 72 of the torque limiter to drive pulley 74; thus, the rotation of guide pulley 68 through the movement of timing belt 66 imparts rotation to the drive pulley 74. In the preferred embodiment, it has been found that gear motor model VM 3539 manufactured by Baldor is acceptable; it has also been found that torque limiter model 250A-2 produced by Morse performs acceptably.

The rotational movement of drive pulley 74 imparts translational movement to drive belt 76. As shown in FIG. 3 more particularly, drive belt 76 engages with outer tube pulley 144, which then causes outer tube 140, transparent disk 40, and upper disk 10 to rotate as described further below.

Outer tube 140 rests on drive wheels 152 as it rotates. Guide wheels 148 ensure horizontal alignment and stability of outer tube 140 as it turns and maintains a consistent alignment between outer tube 140 and support tube 30 during operation. Drive wheels 152 and guide wheels 148 are preferably made of a durable material such as polyurethane. In turn, the relative positions of upper disk 10 and transparent disk 40 in relation to reflecting surface 2 are consistent throughout operation of the attraction, ensuring that reflected images 6 and 8 may be observed by viewers in recognizable form from any position around the attraction.

The preferred embodiment of the present invention also provides a base 20 with a ledge 22 on which viewers may stand to observe reflected images 6 and 8. Base 20 also provides support for screen 16, which in turn provides further protection to the apparatus from objects that may fall on or otherwise strike upper disk 10 and lower disk 12, without inhibiting the ability of the viewers to observe the reflected images. Screen 16 is preferably constructed of laminated glass. Stainless steel rail cap 36 covers the top of the screen and is provided with a groove 38 in which the top edge 134 of the screen is inserted.

It will be appreciated that a variety of structural elements can be use to construct the elements of base 20. The base includes a plurality of peripheral supports 110 that are located around the periphery of the base 20. The peripheral supports provide support for ledge 22, screen 16, and cover 80. The general construction of the peripheral supports 110 (FIG. 3) includes cover support member 112, vertical support member 114, vertical ledge member 116, and ledge support member 118, all of which are preferably constructed of aluminum channel. The upper support panel 120 and lower support panel 122 provide protection to support members 114 and 116 and also provide surfaces that can be painted or otherwise artistically treated to present a more pleasing look to the attraction. Upper support panel 120 is secured to vertical support member 114 by fasteners 94 and is preferably constructed of a plurality of layers of plywood. Lower support panel 122 is secured to vertical ledge member 116 by fasteners 94 and is preferably constructed of a plurality of layers of plywood. Peripheral supports 112 are welded to mounting band 124, which is in turn secured to base plate 126 by fasteners 94. Wheel mounting bracket 128 is welded to cover support member 112 and provides a mounting surface for precision wheels 164.

Cover 80 (FIG. 3) extends around the outer circumference of the base 20 and provides a means of preventing viewers from seeing many of the structural elements of the apparatus while providing an eye appealing artistic element to the apparatus. Cover 80 is preferably constructed from fiber reinforced polyethylene and includes an opening 84, through which the lower edge 136 of screen 16 may be inserted. Cover 80 is secured to spacers 82 and to cover support member 112 by fasteners 94. The spacers are preferably constructed of plywood. The lower edge 136 of screen 16 is held in place by rubber gaskets 90, which are inserted into the inner surface of screen mounting base 88. Screen mounting base 88 is secured to screen support plate 86 by fastener 94. Screen 16 is further secured by applying a suitable sealing material, such as silicon, at opening 84.

Base 20 includes a ledge 22 on which viewers may stand to observe reflected images 6 and 8. Ledge 22 is supported by peripheral supports 110 around the perimeter of the base. Ledge 22 includes ledge top plate 98 which is secured by fasteners 94 to ledge step 100 and ledge support member 118. Ledge top plate 98 is preferably constructed of aluminum plate, while ledge step 100 is preferably constructed of fire retardant plywood. Ledge 22 also includes ledge kick guard 102 which is preferably constructed of stainless steel plate. Kick guard 102 is secured by fasteners 94 to ledge panels 104 and ledge mounting plate 106. Ledge panels 104 are preferably constructed of plywood, while ledge mounting plate 106 is preferably constructed of aluminum.

The present invention has been described above in terms of a presently preferred embodiment so that an understanding of the invention can be conveyed. There are, however, many configurations for apparatuses for displaying anamorphic illusions not specifically described herein, but with which the present invention is applicable. The present invention should therefore not be seen as limited to the particular embodiments described herein, rather, it should be understood that the present invention has wide applicability with respect to optical illusions. Such other configurations can be achieved by those skilled in the art in view of the descriptions herein. Accordingly, the scope of the invention is defined by the following claims.

We claim:

1. An apparatus for providing a viewer with an anamorphic illusion of a scene comprised of reflected images showing recognizable subject matter making up the scene derived from anamorphic depictions of the subject matter which would be unrecognizable to the viewer, the apparatus providing relative movement between different portions of the subject matter in the scene, the apparatus comprising:

a base;

a generally vertical reflecting surface, configured as a volume of revolution about a vertical axis, supported by said base;

a transparent, generally horizontal first surface supported by said base extending around said reflecting surface adjacent its lower end extending outwardly therefrom;

a generally horizontal second surface supported by said base, said second surface spaced closely beneath and extending generally coextensively with said first surface;

means supporting said surfaces for relative rotation between said surfaces about said vertical axis of said reflecting surface;

anamorphic depictions of first subject matter on said first surface positioned to produce reflected images of said first subject matter in said reflecting surface, the relationship between the anamorphism of said depictions and the configuration of said reflecting surface being selected to cause the reflected images to provide a recognizable image of said first subject matter to the viewer;

anamorphic depictions of a second subject matter on said second surface positioned to produce reflected images of said second subject matter in said reflecting surface, the relationship between the anamorphism of said depictions of said second subject matter and the configuration of said reflecting surface being selected to cause the reflected images to provide a recognizable depiction of said second subject matter to the viewer; and rotation means connected to at least one of said surfaces for causing relative rotation between said surfaces to cause the reflections of said second subject matter perceived by the viewer to rotate relative to the reflected images of said first subject matter.

2. An apparatus as defined in claim 1, wherein the first and second subject matters are radially spaced out of overlapping relationship with each other to prevent interference between the reflected images seen by the viewer of said first and second subject matters.

3. An apparatus as defined in claim 1, further comprising means for illuminating the first and second surfaces to increase the light intensity of the reflected images.

4. An apparatus as defined in claim 1, wherein the base includes a circulate pedestal space outside said first and second surfaces extending radially therearound, the pedestal being positioned vertically and horizontally in relation to said reflecting surface to position a viewer standing thereon to be able to view said first and second surfaces and said reflecting surface at the same time.

5. An apparatus as defined in claim 5, further comprising a vertical screen mounted in said base.

6. An apparatus for providing a viewer with an anamorphic illusion of a scene comprised of reflected images showing recognizable subject matter making up the scene derived from anamorphic depictions of the subject matter which would be unrecognizable to the viewer, the apparatus providing relative movement between different portions of the subject matter in the scene, the apparatus comprising:

a base;

a generally vertical reflecting surface, configured as a volume of revolution about a vertical axis, supported by said base;

a transparent, generally horizontal first surface supported by said base extending around said reflecting surface adjacent its lower end extending outwardly therefrom;

a generally horizontal second surface supported by said base, said second surface spaced closely beneath and extending generally coextensively with said first surface;

means supporting said surfaces for relative rotation between said surfaces about said vertical axis said reflecting surface;

anamorphic depictions of first subject matter on said first surface positioned to produce reflected images of said first subject matter in said reflecting surface, the relationship between the anamorphism of said depictions and the configuration of said reflecting surface being selected to cause the reflected images to provide a recognizable image of said first subject matter to the viewer; and anamorphic depictions of a second subject matter on said second surface positioned to produce reflected images of said second subject matter in said reflecting surface, the relationship between the anamorphism of said depictions of said second subject matter and the configuration of said reflecting surface being selected to cause the reflected images to provide a recognizable depiction of said second subject matter to the viewer.

7. An apparatus as defined in claim 6, wherein the first and second subject matters are radially spaced out of overlapping relationship with each other to prevent interference between the reflected images seen by the viewer of said first and second subject matters.

8. An apparatus as defined in claim 6, further comprising means for illuminating the first and second surfaces to increase the light intensity of the reflected images.

9. An apparatus as defined in claim 6, wherein the base includes a circulate pedestal space outside said first and second surfaces extending radially therearound, the pedestal being positioned vertically and horizontally in relation to said reflecting surface to position a viewer standing thereon to be able to view said first and second surfaces and said reflecting surface at the same time.

10. An apparatus as defined in claim 9, further comprising a vertical screen mounted in said base.

11. A method for displaying an anamorphic illusion, comprising:

(a) erecting a generally vertical reflecting surface, configured as a volume of revolution about a vertical axis;

(b) producing anamorphic depictions of first subject matter positioned to produce recognizable reflected images of said first subject matter in said reflecting surface;

(c) reflecting said anamorphic depictions of first subject matter in said reflecting surface;

(d) producing anamorphic depictions of second subject matter positioned to produce recognizable reflected images of said second subject matter in said reflecting surface;

(e) reflecting said anamorphic depictions of second subject matter in said reflecting surface; and (f) rotating at least one of the anamorphic depictions to cause the reflected images of said second subject matter to rotate relative to the reflected images of said first subject matter.

* * * * *